US005829828A

United States Patent [19]

Asfaw

[11] Patent Number: 5,829,828

[45] Date of Patent: Nov. 3, 1998

[54] SELF SECURING CONCEALABLE SEAT COVER

[76] Inventor: Aklog Asfaw, 6188 Golden Valley Rd., Golden Valley, Minn. 55422

[21] Appl. No.: 859,531

[22] Filed: May 19, 1997

[51] Int. Cl.[6] ..... A47C 31/00

[52] U.S. Cl. ..... 297/219.1; 297/218.1; 297/228.1; 297/253

[58] Field of Search ..... 297/218.2, 228.1, 297/219.1, 228, 253, 184.1, 184.11, 226

[56] References Cited

U.S. PATENT DOCUMENTS

| | | | |
|---|---|---|---|
| 2,467,468 | 4/1949 | Duby et al. . | |
| 2,776,705 | 1/1957 | Robinson . | |
| 2,804,914 | 9/1957 | Butcko . | |
| 2,833,341 | 5/1958 | Bornstein . | |
| 3,152,835 | 10/1964 | McKie | 297/226 |
| 3,185,523 | 5/1965 | Morrill, Jr. | 297/226 |
| 4,171,145 | 10/1979 | Pearson, Sr. . | |
| 4,600,238 | 7/1986 | Goodford | 297/219.1 |
| 4,676,376 | 6/1987 | Keiswetter . | |
| 4,723,814 | 2/1988 | Hunt . | |
| 4,790,592 | 12/1988 | Busso et al. | 297/184.11 |
| 5,330,251 | 7/1994 | McGuire . | |
| 5,331,956 | 7/1994 | Bailey | 297/184.1 |

*Primary Examiner*—Peter M. Cuomo
*Assistant Examiner*—Anthony D. Barfield
*Attorney, Agent, or Firm*—Jacobson & Johnson

[57] ABSTRACT

A retractable seat cover mounted in a rigid housing with a retractable seat cover sheet rollably releasable and rollably retractable to enable the seat cover sheet to extend over a seat cushion with the rigid housing including an exterior cushion engaging surface so that when the housing is wedgedly inserted between the junction of backrest cushion and a seat cushion the resiliency of the backrest cushion and the seat cushion cause the cushions to hold the retractable seat cover in a usable but substantially concealed condition.

5 Claims, 2 Drawing Sheets

SELF SECURING CONCEALABLE SEAT COVER

FIELD OF THE INVENTION

This invention relates generally to seat covers and, more specifically, to a retractable seat cover that can be quickly inserted into a vehicle and frictionally retained in an out-of-sight condition within the vehicle without the aid of any tools.

BACKGROUND OF THE INVENTION

One of the difficulties a parent encounters when placing a child in a child seat which is mounted on top of the car seat is that the child's shoes generally rest on the car seat cushion. If the shoes arc dirty it causes the seat cushion to become dirty. While a seat cover is desirable to protect the seat cushion oftentimes the vehicle is used to transport other adults and a dirty seat cover is just as bad as a dirty seat cushion. A further disadvantage of the existing seat covers is that they require special mounting features or are mounted in a visible condition that oftentimes interferes with the normal use of the seat cushions well as presenting an unsightly appearance. The present invention provides a retractable seat cover that can be extended to protect the seat cushion when carrying a child and can be retracted to an out of the way condition that does interfere with either the comfort of the cushion or impair the esthetic appearance of the interior of the vehicle as only a small tab needs to be exposed for a user to extend the retractable seat cover sheet. In addition the attachment or detachment of the retractable seat cover of the present invention requires no tools, which allows a user to remove the retractable seat without marring or damaging the interior of the vehicle.

DESCRIPTION OF THE PRIOR ART

U.S. Pat. No. 2,776,705 discloses a fabric holder for inserting between the cushion support and the backrest to hold a slipcover in place.

U.S. Pat. No. 2,467,468 discloses a rollaway cushion that is located within the backrest of a chair.

U.S. Pat. No. 4,723,814 discloses a seat protector that can be attached on the top and bottom of a seat cushion.

U.S. Pat. No. 2,833,341 with a rod for anchoring the posture cushion in place.

U.S. Pat. No. 2,804,914 shows a retractable seat roller cover that mounts under the seat and can be pulled over the seat cushion to protect the seat cushion.

U.S. Pat. No. 5,330,251 shows a retractable seat cove that includes suction cups for mounting the seat cover on the window above the seat cushion.

U.S. Pat. No. 4,171,145 shows a retractable seat cover for a motorcycle.

U.S. Pat. No. 4,676,376 shows temporary protective seat cover for slipping over the top portion of a backrest.

SUMMARY OF THE INVENTION

Briefly, the invention comprises a retractable seat cover mounted in a rigid housing with the retractable seat cover sheet rollably releasable and rollably retractable to enable the seat cover sheet to temporarily extend over a seat cushion to protect the seat cushion. The housing includes a valley so that the housing can be wedgedly inserted between the junction of a backrest cushion and a seat cushion so that the resiliency of the backrest cushion and the seat cushion can extend into the valley to hold the retractable seat cover in a substantially concealed condition therebetween with the retractable seat cover attachable or detachable without the aid of any tools.

DESCRIPTION OF THE PREFERRED EMBODIMENT

Figure 1:
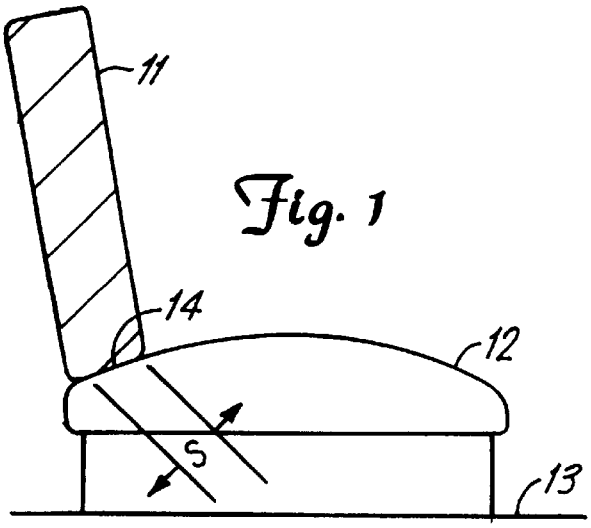
FIG. 1 is a side view of an automobile backrest cushion and a seat cushion.

Referring to FIG. 1 reference numeral 11 identifies a back rest cushion for an automobile and reference numeral 12 identifies a seat cushion 12 that is mounted in vehicle 13. Cushions 11 and 12 are held in pressure contact with each other thereby creating an elongated contact region 14 of length "s" where the resiliency of cushion 12 and cushion 13 cause the cushions to maintain pressure against each other.

Figure 2:
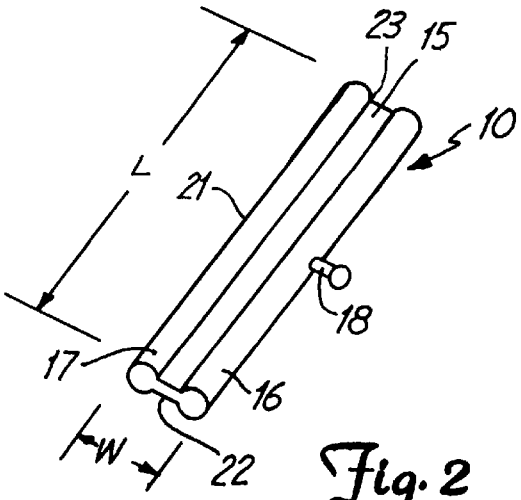
FIG. 2 is a perspective view of a retractable seat cover.

FIG. 2 shows an embodiment of the retractable seat cover device 10 of the present invention having an elongated housing 21 having a first end 16 with a first cylindrical protrusion and a second end 17 with a second cylindrical protrusion with the housing 21 having a width "w" and a length "L" with the width sufficiently narrow so as to interfit in the contact region 14 between cushions 11 and 12 without projecting into the region in front of backrest cushion 11. The housing 21 is sufficiently long so as to extend across a sitting area on the cushion 12 but sufficiently short so as to hidengly fit between the backrest cushion 11 and the seat cushion 12.

Figure 6:
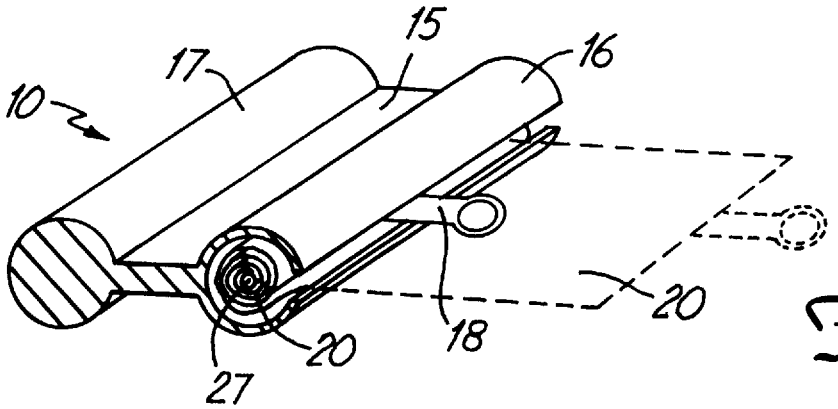
FIG. 6 is a partial cross sectional view showing a spring mounted within the housing of the retractable seat cover.

Housing 21 includes a retractable seat cover sheet 20 (FIG. 6) rollable coiled in the first end 16 of housing 21 with the retractable sheet 20 including a tab or extension 18 for a user to grasp. Housing 21 which is shown in cross section in FIG. 6 shows a torsion spring 21 for retracting seat cover 20 into the first end 16 of housing 21. Located on the second end 17 of housing 21 is a cylindrical protrusion 17 which is spaced from the first end by a web 15. Protrusion 17 is spaced sufficiently far from roller housing 16 so as to create a valley between first end 16 and second end 17 so that when housing 21 is inserted into the interfit contact region 14 between a backrest cushion 11 and a seat cushion 12 the backrest cushion 11 and the seat cushion 12 engage the valley and the first end 17 and the second end 16 to thereby frictionally hold the housing 20 in position.

Figure 3:
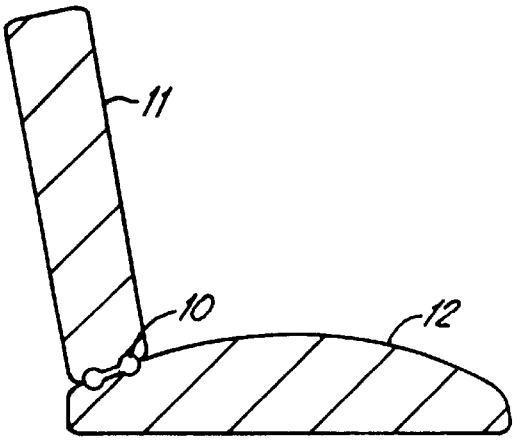
FIG. 3 is a cross sectional view of the automobile backrest cushion and a seat cushion with the retractable seat cover of FIG. 2 mounted therebetween.

FIG. 3 is a cross sectional view showing retractable seat cover 10 positioned in the interfit contact region 14 between cushions 11 and 12. Retractable seat cover 10 is positioned sufficiently deep into interfit region 14 so that only the tab 18 is visible.

Figure 4:
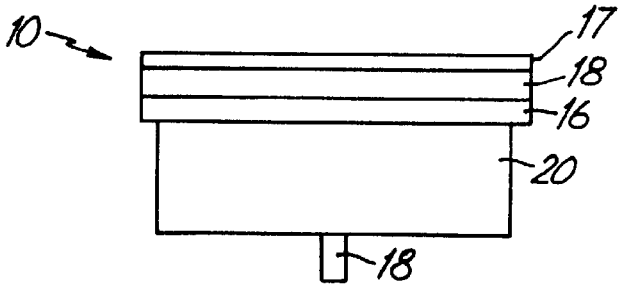
FIG. 4 is a top view of the retractable seat cover with the seat covering partially extended.

FIG. 4 shows a top view of the retractable seat cover 10 having seat cover 20 partially extended to show that the seat cover sheet 20 pulls out from housing 16 by pulling on tab 18.

Figure 5:
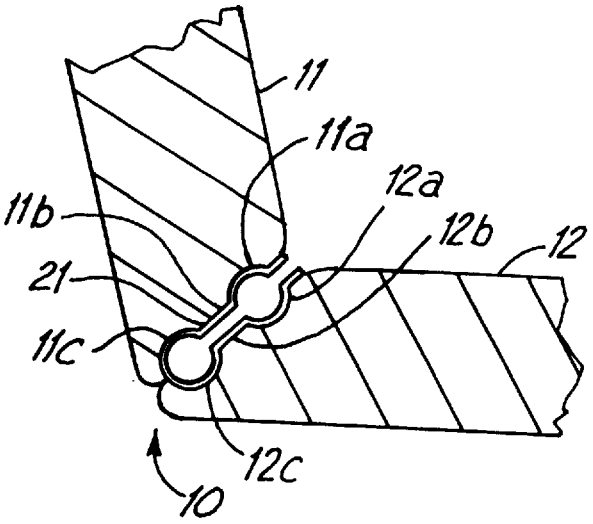
FIG. 5 is an enlarged view of the retractable seat cover frictionally held between the backrest cushion and the seat cushion.

FIG. 5 is an enlarged view showing the seat cushion 12 and backrest cushion 11 sandwiched around retractable seat cover 10. Note that cushion 11, which normally mates against cushion 12, now has a recess 11*a,* an extended section 11*b* and a further recess 11*c* which is formed by one side of the rigid housing 21 of the retractable seat cover 10. Similarly, cushion 12, which normally mates against cushion 11, has a recess 12*a,* an extended section 12*b* and a further recess 12*c* which is formed by one side of the rigid housing 21 of the retractable seat cover 10. Because the resilient cushion can conform to the outside shape of retractable seat cover 10 the cushions provide laterally resistance to hold the retractable seat cover 10 in a concealed but secure position to enable one to pull seat cover sheet 20 therefrom. That is, in the embodiment of FIG. 2 the shape of the seat cover housing 21 cause it to become confined between the interfit region 14 of the cushions 11 and 12 to thereby hold the retractable seat cover housing 20 in a ready to use position. By having the length and width of the housing sufficiently small to fit in the contact region between the cushions 11 and 12 one can conceal the retractable seat cover therebetween.

In addition, the housing for the retractable seat cover is free of sharp edges so that the normal rubbing on the housing as a user rides in the seat will not cause the housing to wear holes in the cushions.

In order to remove retractable seat cover 10 from between the cushions 11 and 12 the user needs to grasp the housing 21 and pull the retractable seat cover free from the cushions. The flexibility and resiliency of cushions 11 and 12 allows the cushions to flex and conform as the retractable housing is inserted or removed from between the cushions to thereby provide a frictional mounted seat cover.

While the embodiment of FIG. 2 is shown with a protrusion that extends parallel to the housing covering the rolled seat cover sheet 20 the housing 21 need not have a protrusion provided that the exterior surface of housing 21 include a frictional material to engage the cushion. The type of frictional material will vary n accordance with the material used in the cushions as well as the pressure between the cushions but can readily be selected from known materials such as fabrics or the like in order to provide the necessary frictional engagement between the cushions and the housing 21 to maintain the retractable seat cover in position.

FIG. 6 shows a cross sectional view of retractable seat cover 10 with dotted lines how illustrating how retractable seat cover sheet 20 can be pulled from housing 16. The sectional view reveal that a central torsion spring 27 is located at the center of rolled seat cover sheet 20 to provide the restoring force for retracting the seat cover sheet 20 within housing 19. A latch mechanism (not shown) allows for the seat cover sheet 20 to be retained in the open position.

Figure 7:
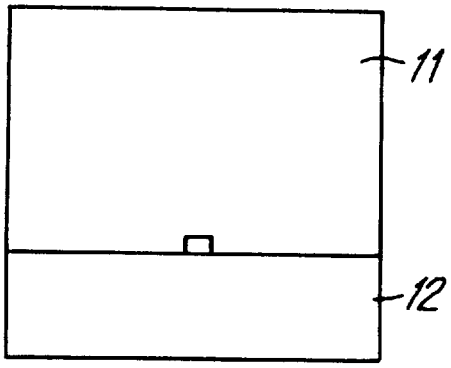
FIG. 7 is a front view of the backrest cushion and a seat cushion of FIG. 1 with the retractable seat cover mounted therein.

FIG. 7 shows front view of the seat cushions 11 and 12 with the only evidence of the existence of the retractable housing being the tab 18 which extends outward to enable a viewer to extend seat cover sheet 20 therefrom.

I claim:

1. For providing a temporary covering for a vehicle seat, in combination:

a vehicle seat having a back rest cushion and seat cushion, a back edge of said seat cushion in close proximity to a bottom edge of said back rest cushion;

a housing snugly but removably wedged between the bottom edge of said back rest cushion and the back edge of said seat cushion;

a cylindrical section on said housing;

a sheet of seat covering material retractably coiled in said cylindrical section; and a gripping member attached to said sheet extending out of said cylindrical section for pulling said sheet out of said cylindrical section and over the seat cushion.

2. The invention as described in claim 1 further including:

a protrusion on said housing spaced from said cylindrical section forming a valley area therebetween for engaging the bottom edge of said back rest cushion.

3. The invention as described in claim 2 in which said protrusion is cylindrical and generally parallel to said cylindrical section.

4. The invention as described in claim 1 wherein said cylindrical section contains a spring for retracting the seat covering material into the cylindrical section.

5. A device for wedging into a vehicle seat between a bottom edge of a back cushion and a back edge of a seat cushion to provide temporary covering for the seat cushion, said device comprising:

a platform section;

a cylindrical section attached to said platform section;

a retractable sheet of seat covering material coiled in said cylindrical section;

a gripping member attached to said sheet extending out of said cylindrical section for pulling said sheet out of said cylindrical section and over the seat cushion;

a cylindrical protrusion attached to said platform section spaced rearwardly from and generally parallel to said cylindrical device, a space between said protrusion and said cylindrical section defining a valley for receiving at least in part the bottom edge of the back cushion.

* * * * *